US006793590B1

(12) United States Patent
Ho

(10) Patent No.: US 6,793,590 B1
(45) Date of Patent: Sep. 21, 2004

(54) GOLF CLUB HAVING A SHOCK-ABSORBING EFFECT

(76) Inventor: Yang Ching Ho, No. 3, Lane 21, Jiahou Rd., Dajia Jen, Taichung (TW), 437

( * ) Notice: Subject to any disclaimer, the term of this patent is extended or adjusted under 35 U.S.C. 154(b) by 0 days.

(21) Appl. No.: 10/461,750

(22) Filed: Jun. 11, 2003

(51) Int. Cl.[7] ..... A63B 53/00
(52) U.S. Cl. ..... 473/320; 403/292
(58) Field of Search ..... 473/239, 296, 473/288, 298–299, 316, 320, 321, 306–308; 403/360–361, 305, 311, 292, 296

(56) References Cited

U.S. PATENT DOCUMENTS 1,652,594 A * 12/1927 Walker ..... 473/308
2,809,144 A * 10/1957 Grimes ..... 156/192
3,368,271 A * 2/1968 Scheffler ..... 29/411
4,340,227 A * 7/1982 Dopkowski ..... 473/288
5,735,752 A * 4/1998 Antonious ..... 473/317
6,203,446 B1 * 3/2001 Collins ..... 473/313
6,371,865 B1 * 4/2002 Magliulo ..... 473/256
2001/0012803 A1 * 8/2001 Feeney ..... 473/316

* cited by examiner

*Primary Examiner*—Stephen Blau
(74) *Attorney, Agent, or Firm*—Alan D. Kamrath; Nikolai & Mersereau, P.A.

(57) ABSTRACT

A golf club includes a hollow conical middle tube having a first end provided with a head and a second end provided with a grip. The middle tube includes an upper rod and a lower rod. The golf club further comprises a connector mounted between the upper rod and the lower rod, so that the upper rod, the connector and the lower rod are combined to form a conical rod. Thus, the connector can absorb and eliminate the shock produced by the head rapidly and actually, thereby preventing the shock from being directly transmitted to the grip so as to protect the user's hand.

3 Claims, 8 Drawing Sheets

GOLF CLUB HAVING A SHOCK-ABSORBING EFFECT

BACKGROUND OF THE INVENTION

1. Field of the Invention

The present invention relates to a golf club, and more particularly to a golf club having a shock-absorbing effect.

2. Description of the Related Art

A conventional golf club 70 in accordance with the prior art shown in FIG. 8 comprises a hollow shaft 71 having a first end provided with a head 72 and a second end provided with a grip 73.

However, the shaft 71 is integrally formed without providing any shock-absorbing device, so that when the head 72 hits the golf ball (not shown), the head 72 produces a large shock (see FIG. 9) which is directly transmitted through the shaft 71 to the grip 73, thereby easily shocking and vibrating the grip 73 and the user's hand.

SUMMARY OF THE INVENTION

The present invention is to mitigate and/or obviate the disadvantage of the conventional golf club.

The primary objective of the present invention is to provide a golf club having a shock-absorbing effect.

Another objective of the present invention is to provide a golf club, wherein the connector can absorb and eliminate the shock produced by the head rapidly and actually, thereby preventing the shock from being directly transmitted to the grip so as to protect the user's hand.

A further objective of the present invention is to provide a golf club, wherein the composite layer mounted on a periphery of the combination of the upper rod, the connector and the lower rod has greater strength and stiffness so as to enhance the combination strength of the upper rod, the connector and the lower rod, and to enhance the shock-absorbing effect.

In accordance with the present invention, there is provided a golf club, comprising a hollow conical middle tube having a first end provided with a head and a second end provided with a grip, wherein:

the middle tube includes an upper rod and a lower rod;

the golf club further comprises a connector mounted between the upper rod and the lower rod, so that the upper rod, the connector and the lower rod are combined to form a conical rod;

the lower rod of the middle tube has an inner conical hole for insertion of the connector;

the connector has a center having a passage co-axial with the middle tube;

the connector has a first end provided with a first smaller diameter portion and a second end provided with a second smaller diameter portion;

the first smaller diameter portion of the connector has an outer conical portion inserted into the inner conical hole of the lower rod;

the first smaller diameter portion has a centring section and a fixing section;

the centring section of the first smaller diameter portion is closely positioned in the inner conical hole of the lower rod;

the fixing section is a helical groove and is provided with an adhesive, so that the first smaller diameter portion is closely fixed in the lower rod;

the second smaller diameter portion of the connector does not have an outer conical portion;

the second smaller diameter portion of the connector has a helical groove which is provided with an adhesive, so that the second smaller diameter portion of the connector is inserted into the upper rod of the middle tube, the connector is closely fixed on the upper rod of the middle tube, and the upper rod, the connector and the lower rod are co-axial with each other;

the golf club further comprises a composite layer mounted on a periphery of a combination of the upper rod, the connector and the lower rod; and the composite layer consists of a metallic filament and fiber.

Further benefits and advantages of the present invention will become apparent after a careful reading of the detailed description with appropriate reference to the accompanying drawings.

DETAILED DESCRIPTION OF THE INVENTION

Figure 1:
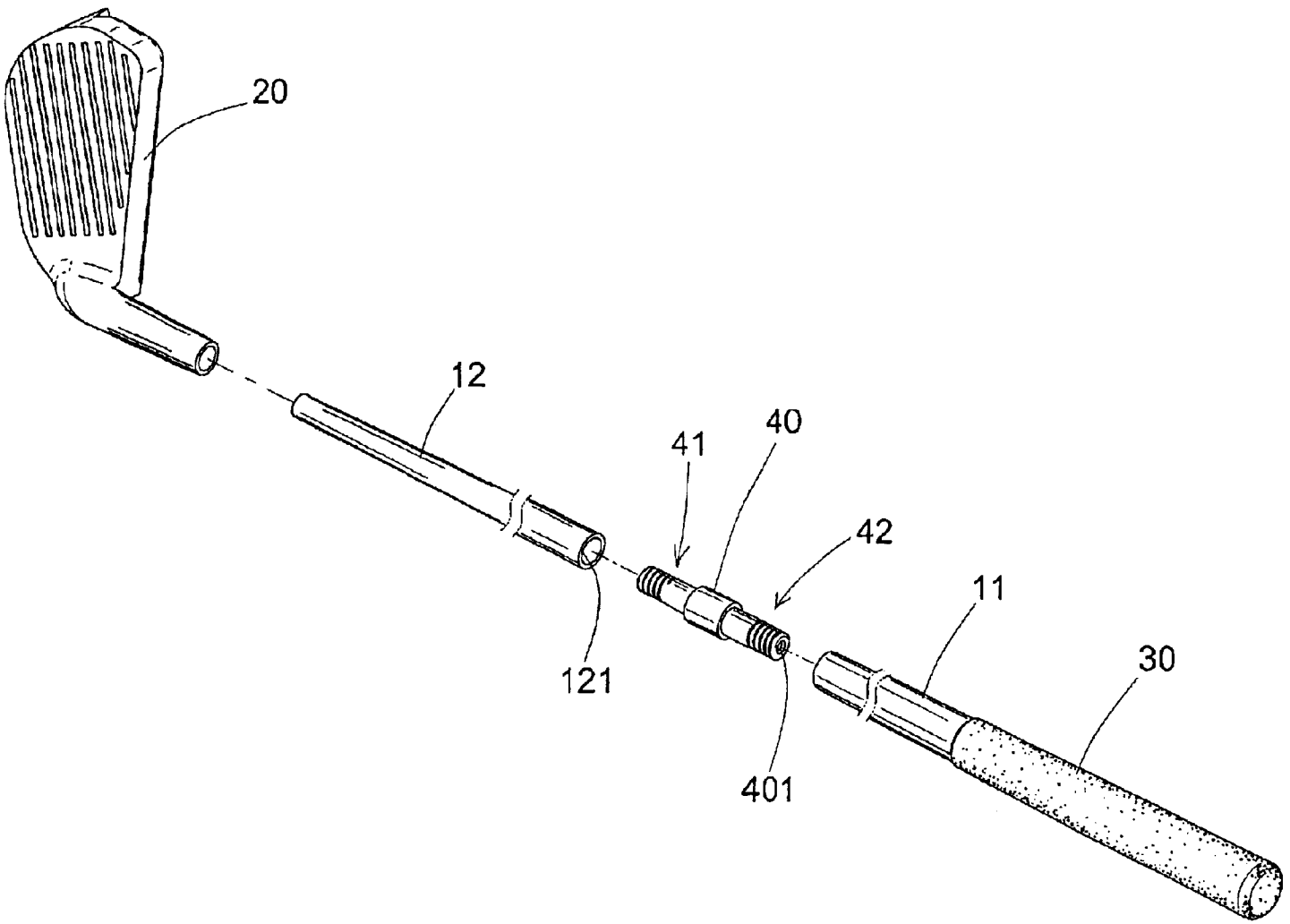
FIG. 1 is an exploded perspective view of a golf club in accordance with the preferred embodiment of the present invention.

Referring to the drawings and initially to FIGS. 1–6, a golf club in accordance with the preferred embodiment of the present invention comprises a hollow conical middle tube 10 (see FIG. 4) having a first end provided with a head 20 and a second end provided with a grip 30.

Figure 3:
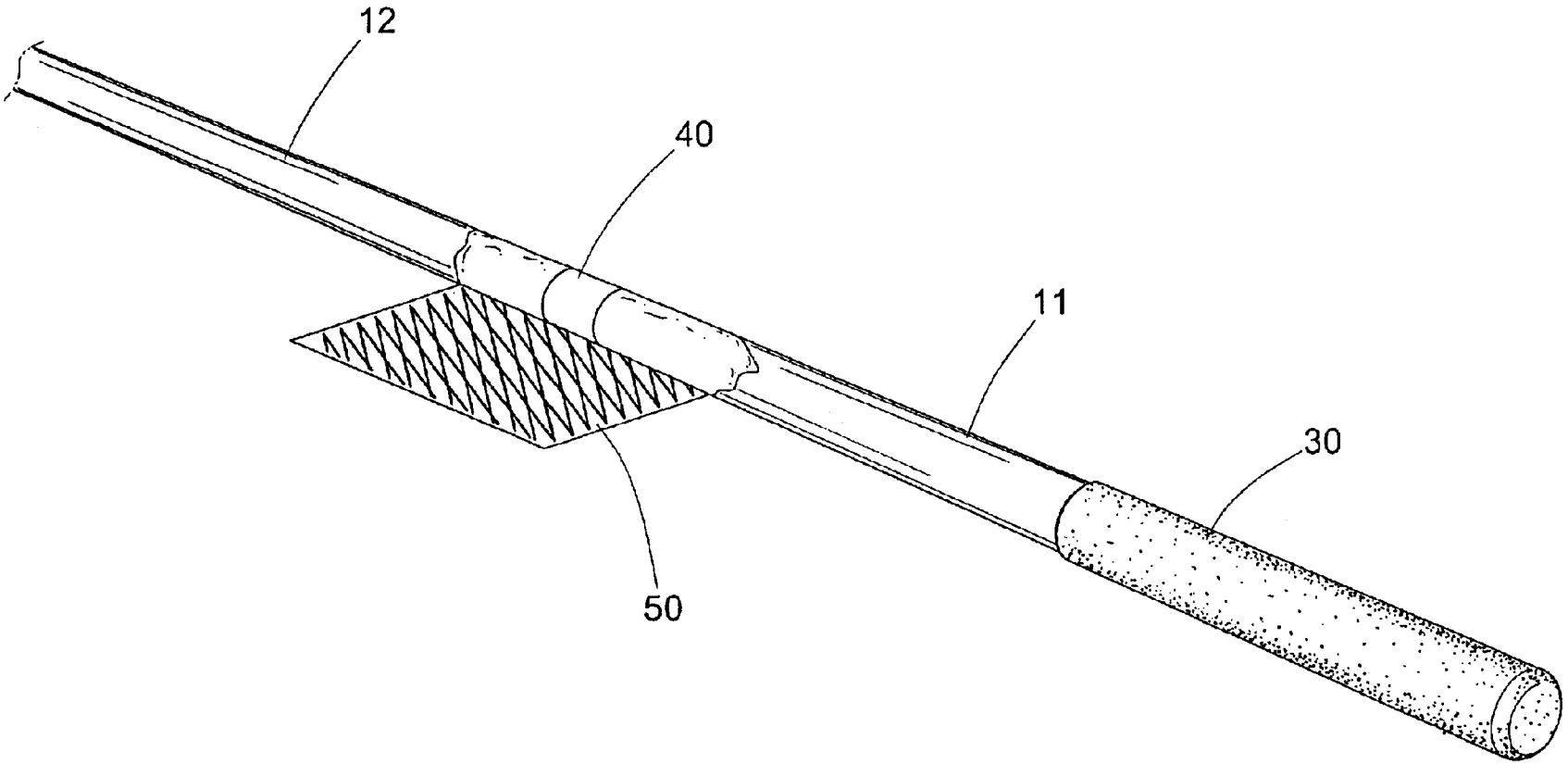
FIG. 3 is a perspective assembly view of the golf club in accordance with the preferred embodiment of the present invention.

The middle tube 10 includes an upper rod 11 and a lower rod 12. The golf club further comprises a connector 40 mounted between the upper rod 11 and the lower rod 12. The connector 40 is made of shock-absorbing material such as aluminum. Thus, the upper rod 11, the connector 40 and the lower rod 12 are combined to form a conical rod as shown in FIG. 3.

Figure 2:
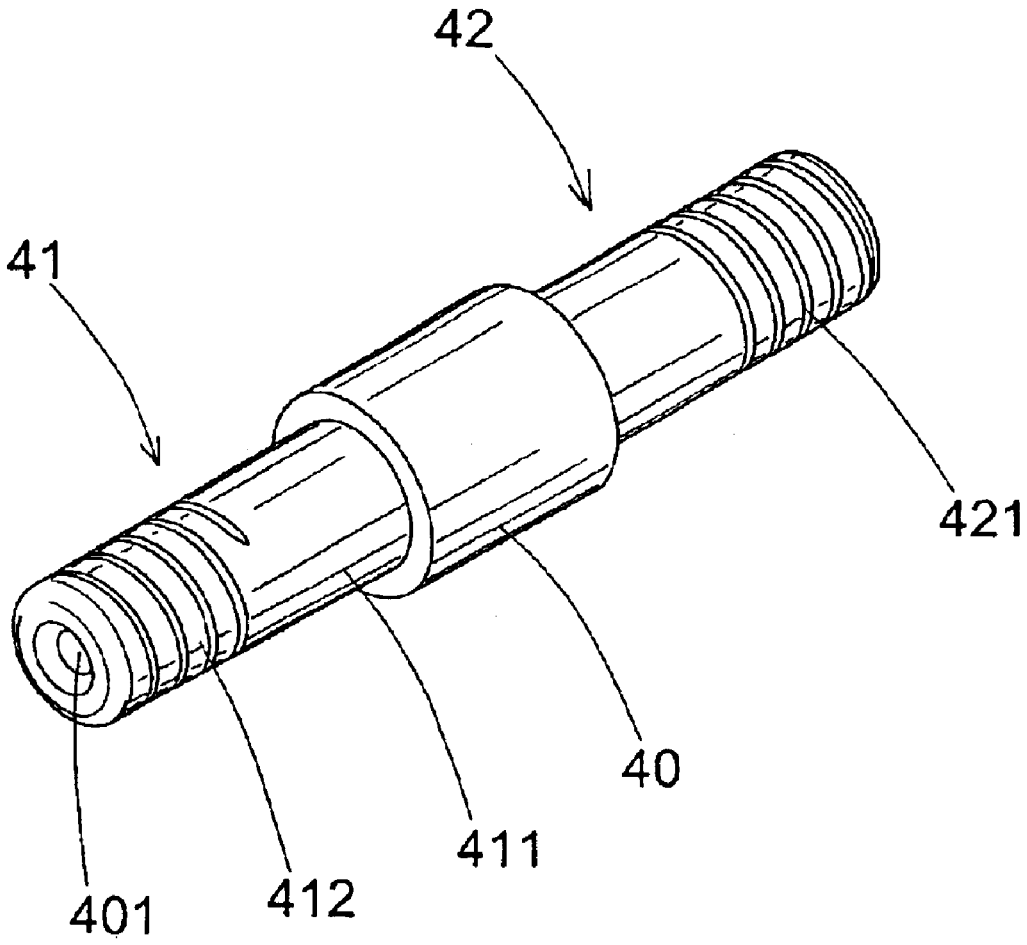
FIG. 2 is a perspective view of a connector of the golf club in accordance with the preferred embodiment of the present invention.

The lower rod 12 of the middle tube 10 has an inner conical hole 121 for insertion of the connector 40. The center of the connector 40 has a passage 401 co-axial with the middle tube 10. The connector 40 has a first end provided with a first smaller diameter portion 41 and a second end provided with a second smaller diameter portion 42. The first smaller diameter portion 41 of the connector 40 has an outer conical portion inserted into the inner conical hole 121 of the lower rod 12. As shown in FIG. 2, the first smaller diameter portion 41 has a centring section 411 and a fixing section 412. The centring section 411 of the first smaller diameter portion 41 is closely positioned in the inner conical hole 121 of the lower rod 12. The fixing section 412 is a helical groove. The fixing section 412 is provided with an adhesive (not shown), so that the first smaller diameter portion 41 is closely fixed in the lower rod 12 as shown in FIGS. 5 and 6.

The second smaller diameter portion 42 of the connector 40 does not have an outer conical portion. The second smaller diameter portion 42 of the connector 40 has a helical groove 421 which is provided with an adhesive (not shown), so that the second smaller diameter portion 42 of the connector 40 is inserted into the upper rod 11 of the middle tube 10, and the connector 40 is closely fixed on the upper rod 11 of the middle tube 10. Thus, the upper rod 11, the connector 40 and the lower rod 12 are co-axial with each other as shown in FIG. 5.

The golf club further comprises a composite layer 50 (see FIGS. 4–6) mounted on a periphery of a combination of the upper rod 11, the connector 40 and the lower rod 12. The composite layer 50 is made of composite material. The composite layer 50 is a layer structure which is made by melted titanium filament and fiber, so that the composite layer 50 has greater strength and stiffness so as to enhance the combination strength of the upper rod 11, the connector 40 and the lower rod 12, and to provide a shock-absorbing effect.

Figure 4:
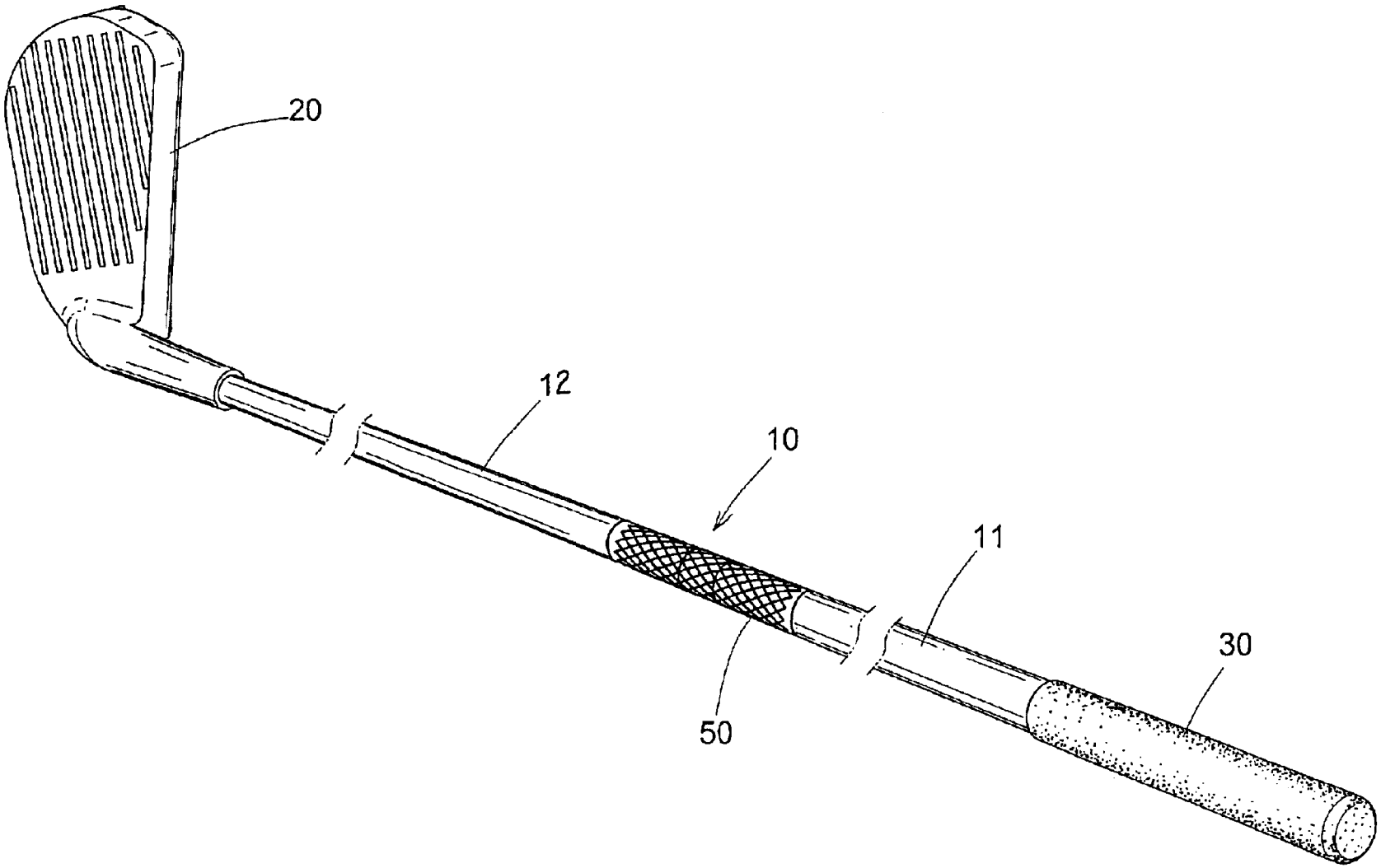
FIG. 4 is a perspective assembly view of the golf club in accordance with the preferred embodiment of the present invention.
Figure 5:
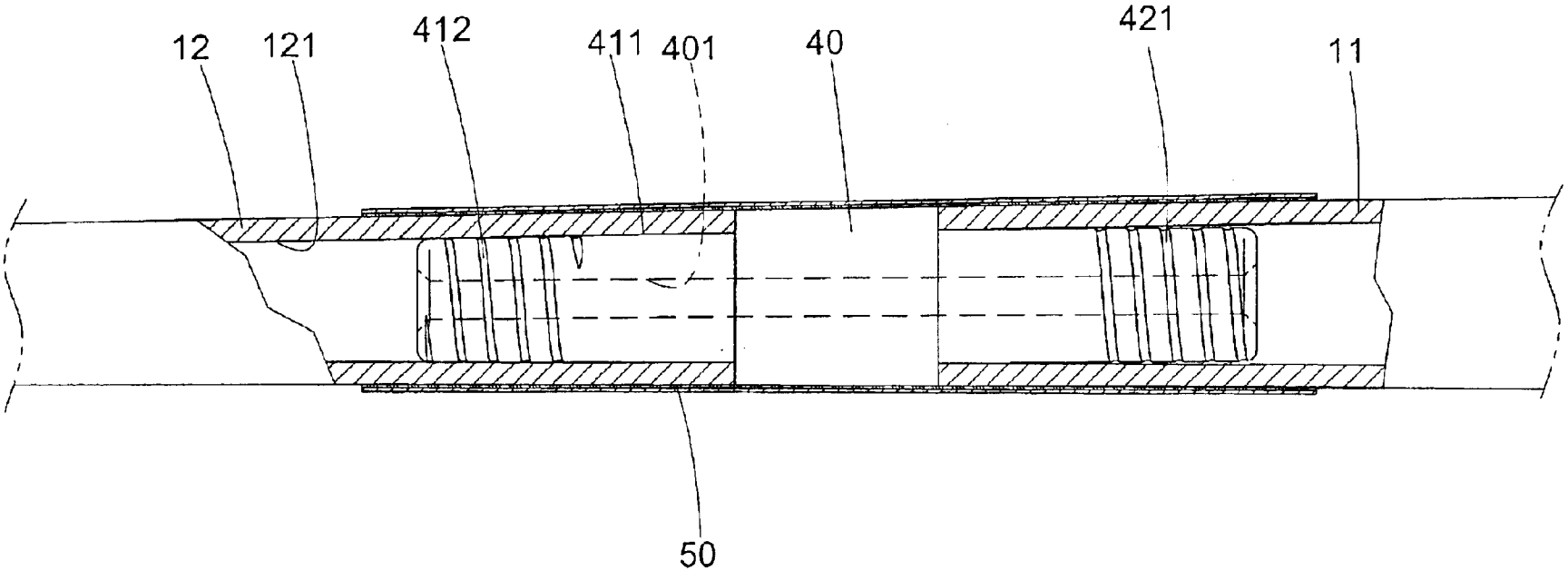
FIG. 5 is a front plan cross-sectional assembly view of the golf club as shown in FIG. 1.
Figure 6:
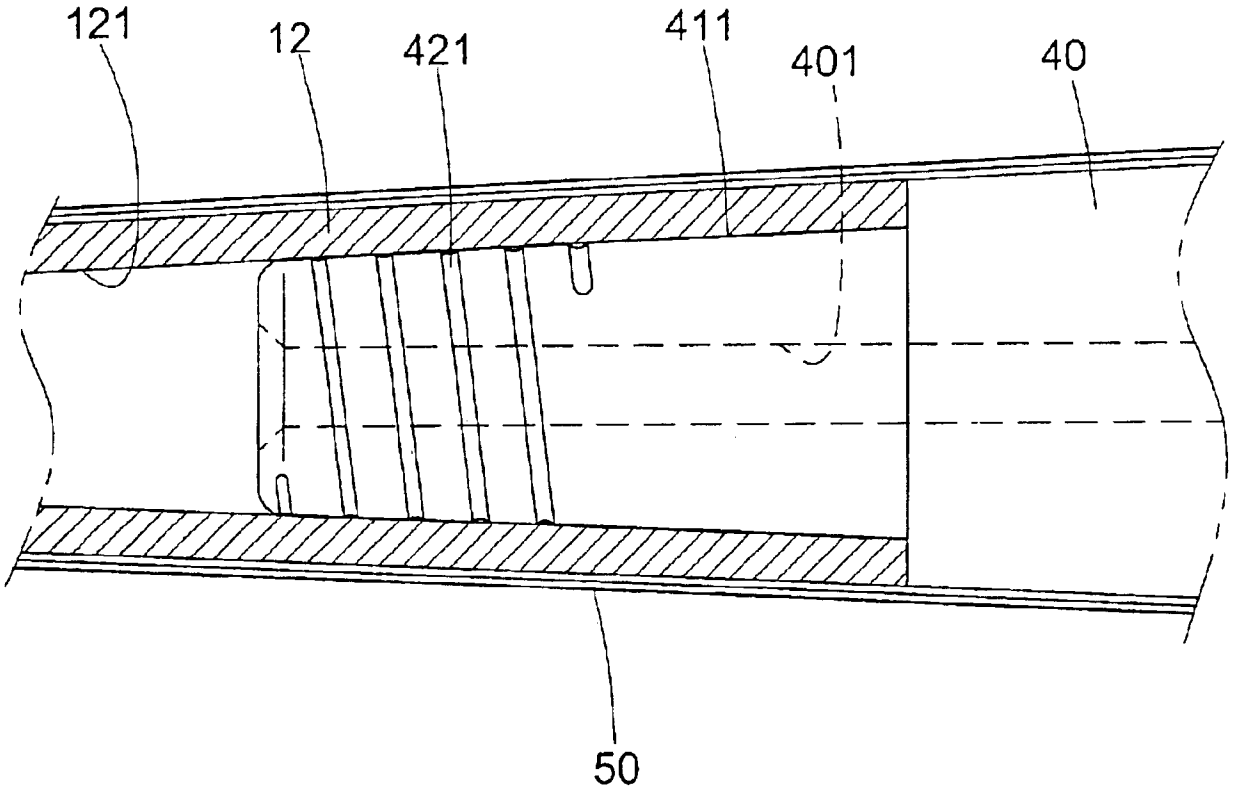
FIG. 6 is a partially enlarged view of the golf club as shown in FIG. 5.

As shown in FIGS. 4–6, the bottom end of the lower rod 12 of the middle tube 10 is inserted into the head 20. Then, the first smaller diameter portion 41 of the connector 40 is inserted into and fixed in the inner conical hole 121 of the lower rod 12. At this time, the centring section 411 of the first smaller diameter portion 41 is used to calibrate the center of the connector 40 and the lower rod 12. In addition, the fixing section 412 is provided with an adhesive (not shown), so that the first smaller diameter portion 41 is rotated into and closely fixed in the lower rod 12 as shown in FIGS. 5 and 6.

The center of the connector 40 has a passage 401 co-axial with the middle tube 10. Thus, when the first smaller diameter portion 41 of the connector 40 is inserted into the inner conical hole 121 of the lower rod 12, the air contained in the lower rod 12 leaks outward through the passage 401, so that the first smaller diameter portion 41 of the connector 40 and the lower rod 12 will not form a vacuum state, thereby facilitating the first smaller diameter portion 41 of the connector 40 being inserted into the inner conical hole 121 of the lower rod 12.

Finally, the second smaller diameter portion 42 of the connector 40 is inserted into the upper rod 11 of the middle tube 10. At this time, the helical groove 421 of the second smaller diameter portion 42 of the connector 40 is provided with an adhesive (not shown), so that the second smaller diameter portion 42 of the connector 40 is closely fixed on the upper rod 11 of the middle tube 10 as shown in FIG. 5.

Figure 7:
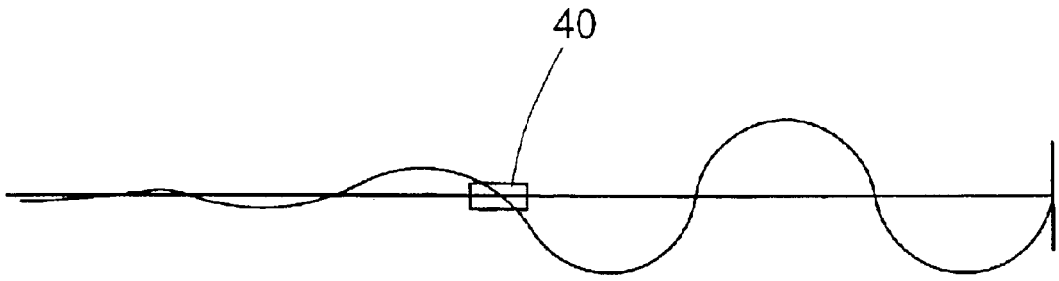
FIG. 7 is a schematic view of the wave of a dynamic energy after the golf club hits the golf ball.
Figure 9:
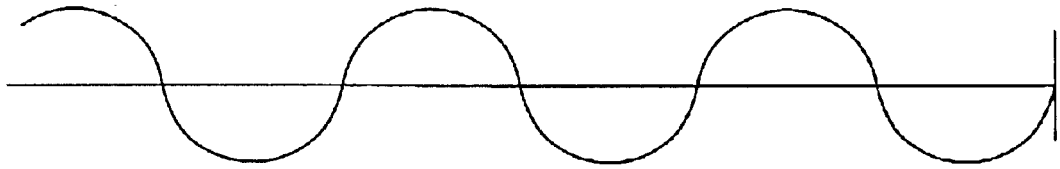
FIG.9 PRIOR ART
FIG. 9 is a schematic view of the wave of a dynamic energy after the conventional golf club hits the golf ball.
Figure 8:
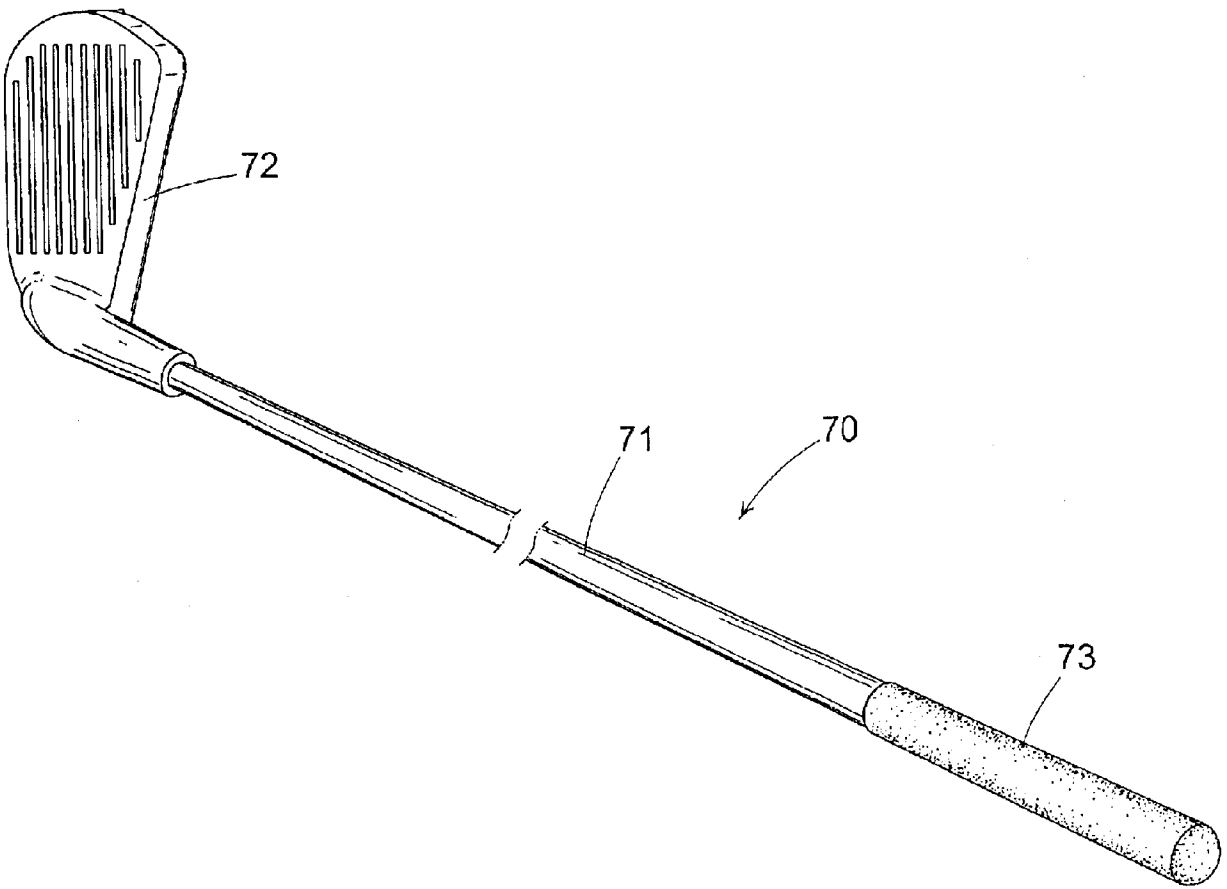
FIG.8 PRIOR ART
FIG. 8 is a perspective view of a conventional golf club in accordance with the prior art.

When the head 20 hits the golf ball (not shown), the head 20 produces a large shock which is transmitted through the lower rod 12 to the connector 40. In such a manner, the shock is largely absorbed and eliminated by the first smaller diameter portion 41, the connector 40 and the second smaller diameter portion 42, so that only little shock is transmitted to the grip 30. Thus, the connector 40 can absorb and eliminate the shock produced by the head 20 rapidly and actually as shown in FIG. 7, thereby preventing the shock from being directly transmitted to the grip 30 so as to protect the user's hand.

In addition, the composite layer 50 mounted on a periphery of the combination of the upper rod 11, the connector 40 and the lower rod 12 has greater strength and stiffness so as to enhance the combination strength of the upper rod 11, the connector 40 and the lower rod 12, and to enhance the shock-absorbing effect.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A golf club, comprising a hollow conical middle tube having a first end provided with a head and a second end provided with a grip, wherein:

the middle tube includes an upper rod and a lower rod;

the golf club further comprises a connector mounted between the upper rod and the lower rod, so that the upper rod, the connector and the lower rod are combined to form a conical rod;

the lower rod of the middle tube has an inner conical hole for insertion of the connector;

the connector has a center having a passage co-axial with the middle tube;

the connector has a first end provided with a first smaller diameter portion and a second end provided with a second smaller diameter portion;

the first smaller diameter portion of the connector has an outer conical portion inserted into the inner conical hole of the lower rod;

the first smaller diameter portion has a centring section and a fixing section;

the centring section of the first smaller diameter portion is closely positioned in the inner conical hole of the lower rod;

the fixing section is a helical groove and is provided with an adhesive, so that the first smaller diameter portion is closely fixed in the lower rod;

the second smaller diameter portion of the connector does not have an outer conical portion;

the second smaller diameter portion of the connector has a helical groove which is provided with an adhesive, so that the second smaller diameter portion of the connector is inserted into the upper rod of the middle tube, the connector is closely fixed on the upper rod of the middle tube, and the upper rod, the connector and the lower rod are co-axial with each other;

the golf club further comprises a composite layer mounted on a periphery of a combination of the upper rod, the connector and the lower rod; and the composite layer consists of a metallic filament and fiber.

2. The golf club in accordance with claim 1, wherein the connector is made of aluminum.

3. The golf club in accordance with claim 1, wherein the metallic filament of the composite layer is made of titanium.

* * * * *